US010166788B2

(12) United States Patent
Gracia Verdugo et al.

(10) Patent No.: US 10,166,788 B2
(45) Date of Patent: Jan. 1, 2019

(54) DETERMINING INSUFFICIENT SUCTION FORCE

(71) Applicants: Antonio Gracia Verdugo, Sant Cugat del Valles (ES); Aleix Fort Filgueira, Sant Cugat del Valles (ES); Norman Guillo, Sant Cugat del Valles (ES)

(72) Inventors: Antonio Gracia Verdugo, Sant Cugat del Valles (ES); Aleix Fort Filgueira, Sant Cugat del Valles (ES); Norman Guillo, Sant Cugat del Valles (ES)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 15/547,699

(22) PCT Filed: Apr. 24, 2015

(86) PCT No.: PCT/EP2015/058979

§ 371 (c)(1),
(2) Date: Jul. 31, 2017

(87) PCT Pub. No.: WO2016/169625

PCT Pub. Date: Oct. 27, 2016

(65) Prior Publication Data

US 2018/0009240 A1 Jan. 11, 2018

(51) Int. Cl.
*B41J 11/00* (2006.01)
*G03G 15/00* (2006.01)

(52) U.S. Cl.
CPC ..... *B41J 11/0085* (2013.01); *G03G 15/6529* (2013.01)

(58) Field of Classification Search
CPC ..... B41J 11/00; B41J 11/0005; B41J 11/001; B41J 11/0015; B41J 11/0055;
(Continued)

(56) References Cited

U.S. PATENT DOCUMENTS 5,329,852 A 7/1994 Bolza-Schuenemann et al.
5,414,491 A 5/1995 Bryant
(Continued)

FOREIGN PATENT DOCUMENTS

DE 19929274 A1 12/2000
EP 1022147 7/2000

OTHER PUBLICATIONS

HP Designjet L25500 Printer Series Service Manual.

*Primary Examiner* — Kristal Feggins
(74) *Attorney, Agent, or Firm* — HP Inc. Patent Department

(57) ABSTRACT

Provided in one example is a printing system. The system includes a printing zone including a platen (50). The system includes a drive to move a medium (58) through the printing zone. The system includes a suction force generator (78) to generate a suction force to hold down the medium onto the platen while the drive moves the medium through the printing zone. The system includes a sensor (52) to monitor the movement of the medium through the printing zone in a medium advance direction. The system includes a controller to determine that the suction force generated by the suction source generator is insufficient based on an output of the sensor.

18 Claims, 8 Drawing Sheets

(58) Field of Classification Search
CPC .... B41J 11/0085; B41J 11/007; B41J 13/223;
B41J 13/226; G03G 15/6529
See application file for complete search history.

(56) References Cited

U.S. PATENT DOCUMENTS

| | | | | |
|---|---|---|---|---|
| 6,247,861 | B1 | 6/2001 | Wotton et al. | |
| 7,643,130 | B2 | 1/2010 | Yoshitake et al. | |
| 8,308,288 | B2 | 11/2012 | Fukui et al. | |
| 2002/0015610 | A1 | 2/2002 | Beehler et al. | |
| 2007/0146457 | A1 | 6/2007 | Kito | |
| 2012/0242736 | A1 | 9/2012 | Imamura | |
| 2017/0217219 | A1* | 8/2017 | De Boer | B41J 11/0085 |

* cited by examiner

| COLUMN A: high vacuum media not advanced | | | | COLUMN B: media out of focus | | | | COLUMN C: vacuum normal (a 8000) | | | |
|---|---|---|---|---|---|---|---|---|---|---|---|
| | getPhotoAvg | | getCurrentOLF | | getPhotoAvg | | getCurrentOLF | | getPhotoAvg | | getCurrentOLF |
| | avg | std | | | avg | std | | | avg | std | |
| round1 | | | 1000000 | round1 | | | 1000000 | round1 | | | 1001001 |
| round2 | | | 1000832 | round2 | | | 1000000 | round2 | | | 1000803 |
| round3 | | | 1000000 | round3 | | | 1000000 | round3 | | | 1000767 |
| round4 | | | 1001463 | round4 | | | 1000000 | round4 | | | 1000929 |
| round5 | | | 1000000 | round5 | | | 1000000 | round5 | | | 1000831 |

FIG 7

DETERMINING INSUFFICIENT SUCTION FORCE

BACKGROUND

In printing systems, a medium or substrate may be moved over a platen in a printing zone area in which printing on the medium takes place. Printing systems may use suction force, such as vacuum pressure, to control motion and flatness of the medium over the printing zone area. A source for providing the suction force may comprise fans working at a certain rotation speed (duty, rpm) in order to provide enough suction force to hold down the medium onto the platen in the printing zone area.

BRIEF DESCRIPTION

Examples will now be described, by way of non-limiting examples only, with reference to the accompanying drawings, in which:

FIG. 7 is a table showing outputs of a specific sensor; and

DETAILED DESCRIPTION

Figure 1:
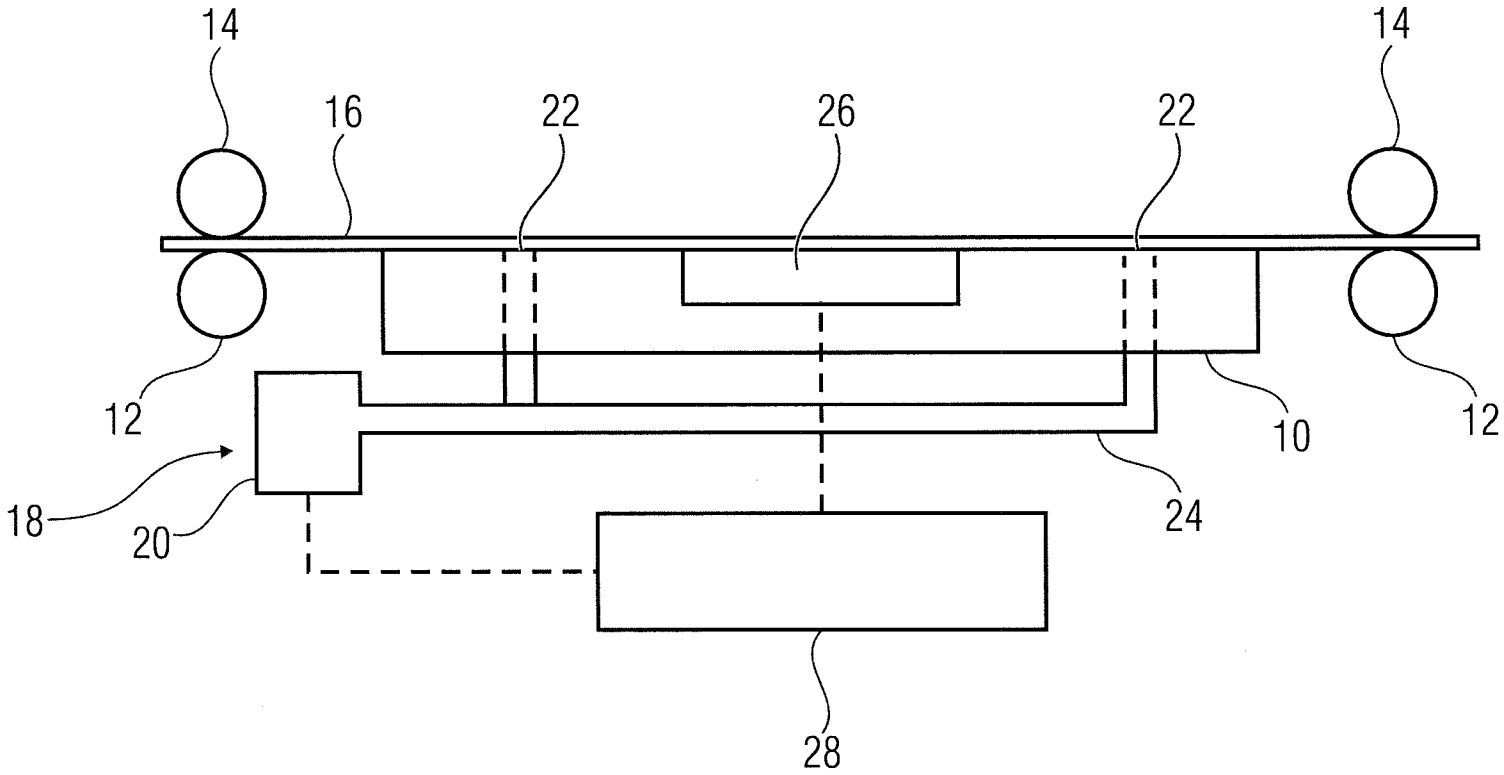
FIG. 1 is a schematic block diagram of a printing system according to one example.

Referring now to FIG. 1 there is shown a simplified illustration of a printing system according to one example.

As shown in FIG. 1, the printing system comprises a printing zone in which a platen 10 is arranged. The platen may be a planar platen or may be a drum platen. Drive rollers 12 and pinch rollers 14 associated with the drive rollers 12 represent a drive for moving a medium 16 through the printing zone. The medium may be a print medium. The print medium may be of any material, such as paper, transparencies, heavy photo stock, etc. The print medium may be cut pages or may be an "endless" medium such as a medium fed from a media roll. Generally, the medium may be moved through the printing zone intermittently from one print swath to the next print swath. Intermittently means that after a first print swath is printed the medium is moved by a distance corresponding to the width of a print swath and then the next print swath is printed. Other printing systems, which the teaching herein can applied to, include page wide array systems using printbars.

The printing system comprises a suction force generator 18 for generating a suction force to hold down media 16 onto platen 10 while it is moved through the printing zone by drive rollers 12. Suction force generator 18 may comprise a suction force source 20, such as a fan, suction force openings 22 in a top plane of platen 10 and suction force channels 24 fluidically connecting suction force source 20 to suction force openings 22.

The printing system comprises a sensor 26 to monitor movement of medium 16 through the printing zone in a media advance direction. Sensor 26 may comprise a camera to capture several pictures of medium 16 successively while medium 16 is moved through the printing zone by drive rollers 12. Camera 16 may be arranged to capture pictures of the underside of the medium. The camera may be stationary in that it is focused on a fixed region of the printing zone over which the medium is moved. For each of the pictures, an image correlation versus the previous one may be performed and the result may be output by the image sensor. Sensor 26 extracts features from the pictures and performs the correlation based on the extracted features. The features may be features of the medium itself, such as fibers thereof, or may be features provided on the medium, such as printed marks.

For example, the sensor may be an optical media advance sensor, which is used to control movement of medium 16 through the printing zone area. An example of such an optical media advance sensor is known as optical media advance sensor ("OMAS") sensor from Hewlett-Packard Company, USA.

Several pictures are taken during the media movement, wherein the term "media movement" may refer to a movement of the medium over a distance corresponding to the width of a print swath. The medium is advanced by a nominal distance from picture to picture. For each of the pictures an image correlation versus the previous one may be performed. By doing so, the actual distance of the medium moved from picture to picture can be determined. The actual distance may be compared to the nominal distance. If a value indicating a deviation of the actual distance from the nominal distance exceeds a threshold, this may be determined as representing a miscorrelation between pictures. For example, the threshold may be set to 10% of the nominal distance.

The values obtained while the medium is moved over the nominal distance corresponding to a swath may be considered to determine whether a misnavigation takes place. For example, a misnavigation may be determined in case a specific percentage of the values, such as 25% of the values, indicate a miscorrelation. Thus, a misnavigation is considered if there is too poor or no correlation.

The output of the sensor may be used to control movement of the medium. The medium is advanced by a nominal distance from picture to picture plus a delta value coming from the correlation between pictures. By adding together the total advance from the pictures taken (while the medium is moved a nominal distance corresponding to a swath), a total advance error may be computed and fed to the drive (which may include a media movement servo) to increase or decrease the movement length for the next movement. Once the media movement has ended, an additional picture may be taken to obtain a real stop position. This information may be used to calculate a media advance factor (OLF) for the next movement.

Thus, in examples, the sensor is to determine a media advance factor based on the monitored movement, wherein the media advance factor indicates the distance by which the medium is moved between printing swaths on the medium.

The printing system comprises a controller 28 in communication with sensor 26 and suction force source 20 as shown by broken lines in FIG. 1. Controller 28 may comprise a processor, such as a microprocessor, coupled to a memory through an appropriate communication bus. The memory may store machine readable instructions and the processor may execute the instructions to cause the controller to provide the functionality described herein and to operate a printing system as described herein.

In an example, the printing system may be an inkjet printing system in which at least one inkjet printhead (not shown in FIG. 1) is provided to print on medium (substrate) 16 by applying ink of at least one color onto the medium. Other examples of printing systems include electro-photographic printing systems, such as liquid toner electro-photographic printing systems or dry toner printing systems. Generally, a printing system may comprise a printer as a stand-alone device or by a combination of a printing device and a computing device.

During printing, particles, such as aerosol particles coming from the ink firing process or fibers coming from medium like cloths or woven materials, may deposit in areas different from the medium and may in the end be aspired by the suction force openings 22 in the upper face of platen 10. These particles may deposit at suction force openings 22 and/or within suction force channels 24. With time these particles tend to reduce the suction force and capacity of the suction force generator. Thus, the suction force generated by the suction force generator may not be enough to hold down properly the medium onto platen 10. Holding down the medium properly means that the medium rests on the platen while the drive moves the medium through the printing zone. Not holding down the medium properly may result in crashes and ink smears since the printhead may touch the medium. Thus, the printing system may fail before service maintenance actions. This may impact cost through user complaint and service call.

It has been recognized that situations of a reduced suction power can be identified by monitoring the movement of the medium through the printing zone. Controller 28 may receive an output of sensor 26 and may determine that the suction force generated by the suction force generator is insufficient to hold down the medium properly on the platen based on an output of sensor 26. For example, controller 28 may determine that the suction force generated by the suction force generator is insufficient if the output of sensor 26 indicates a misnavigation. Accordingly, degradation in the suction power to hold down the media may be determined based on the output of sensor 26. In addition, action may be taken to modify the behavior of the printing device or to give advice to a user.

In examples, the controller is to determine that the suction force is insufficient if the output of the sensor indicates at least one of specific conditions. A specific condition may be that a distance by which the medium is moved is not determined or deviates from a nominal distance by more than a distance deviation threshold. Another condition may be that the sensor does not determine the media advance factor. Another condition may be that a change of the media advance factor exceeds a media advance factor change threshold. Another condition may be that a rate of change of the media advance factor exceeds a media advance factor change threshold. Another condition may be that a difference of the media advance factor from a nominal media advance factor exceeds a media advance factor difference threshold. Another condition may be that pictures captured by the camera are out of focus.

Thus, in examples, the controller determines that the suction force is insufficient if the media advance factor is not obtained or changes too much too frequently or if the pictures taken are too much out of focus compared to a reference. Thus, in examples, degradation of the suction force is determined or estimated if the sensor cannot navigate properly. Navigating by the sensor means that the sensor provides control signal for the drive in order to compensate for deviations of the actual movement from the nominal movement.

In examples, the determination may include at least one of additional parameters of printer usage, such as for example the printing time, the distance by which the substrate is moved, the type of substrate, etc. In examples, the controller is to consider additional parameters in determining that the suction force is insufficient, wherein the additional parameters comprise an amount of ink or toner consumed by the printing system (for example since a last maintenance) and/or a distance by which the medium is moved through the printing zone upon properly loading the medium into the printer. In examples, the controller may determine that the suction force is insufficient if the output of the sensor fulfills at least one of the above conditions and if the amount of ink or toner consumed is above a consumption threshold. In examples, the controller may determine that the suction force is insufficient if the output of the sensor fulfills the condition and if the medium is moved through the printing zone by not more than a specific distance upon properly loading the medium into the printer. The fact that the medium is properly loaded into the printer may be determined by the optical medium advance sensor or additional sensors. Properly loaded means that the medium is at a desired position after loading.

In examples, a corrective action is taken in response to the determination. In examples, the controller may be to control the suction force generator to increase the suction force if it is determined that the suction force is insufficient. For example, the duty of at least one fan may be increased so as to increase the vacuum force and to compensate for the degradation in vacuum force. In examples, the controller may be to inform a user that the suction force is insufficient via a user interface, which may be at least one of a visual interface and an acoustical interface. For example, feedback may be provided to a user so as to enable corrective actions before service maintenance actions are performed.

In examples, the sensor may be an optical media advance sensor (OMAS) which is a sensor that basically takes photos to detect the back of the medium as it moves across the platen. The sensor may be able to evaluate the exact movement of the medium and to communicate any small adjustments required by the system to move the substrate smoothly in an intended manner. In other words, the sensor may be able to detect the media advance factor and to provide feedback to the system, such as controller 28 or a drive servo, that permits controlling the drive to move the medium through the printing zone in an intended manner. Several pictures are taken during media movement and for each of them, an image correlation versus the previous one is performed and the output is reported. The presence of problems with such kind of sensor is usually reported when the correlation between images has failed, i.e. if there is a poor or no coincidence between images. Thresholds are programmed for the sensor to make self compensation values on cases of a small number of pictures for which the correlation failed, and can be deactivated if further errors above a certain threshold are achieved. While this information may not be important for the substrate advance itself, it may be analyzed to be used in determining reduction of suction force power.

Generally, the sensor may be located at the back of the medium, such as under the printing zone. Window optics may be provided to detect the back of the medium and to periodically take photos that are compared one to each other (autocorrelation of images) to determine how the substrate advance needs to be modified to have a smoother advance. When the image comparison becomes difficult because the optics of the sensor gets out of focus because the substrate is not properly hold down because of a vacuum loss then a proper advance factor cannot be calculated.

Because different scenarios may happen when taking these back substrate pictures (also known as substrate navigation), as cited above, additional parameters may be taken into account to enhance detection and response. For instance, it may not be expected to have problems with the suction force generator if not more than 20 liter of ink have been consumed since maintenance of the suction force generator was performed last. Thus, in examples, even if the output of the sensor fulfills the condition, this will not result in a determination in that the suction force generated by the suction source generator is insufficient if not more than a predetermined amount of ink or toner has been consumed since the printing system was put into operation or since maintenance of the suction force generator was performed last. For instance, a medium that has been properly loaded and can be properly detected by the optical media advance sensor during the loading process is not expected to fail by any means in terms of problems of the sensor itself (sensor misdetection) during advance by a specific distance, such as the first 50 cm of the plot. Thus, in examples, if the output of the sensor fulfills the condition during this advance, this is taken as an indication that the suction force is insufficient.

Figure 2:
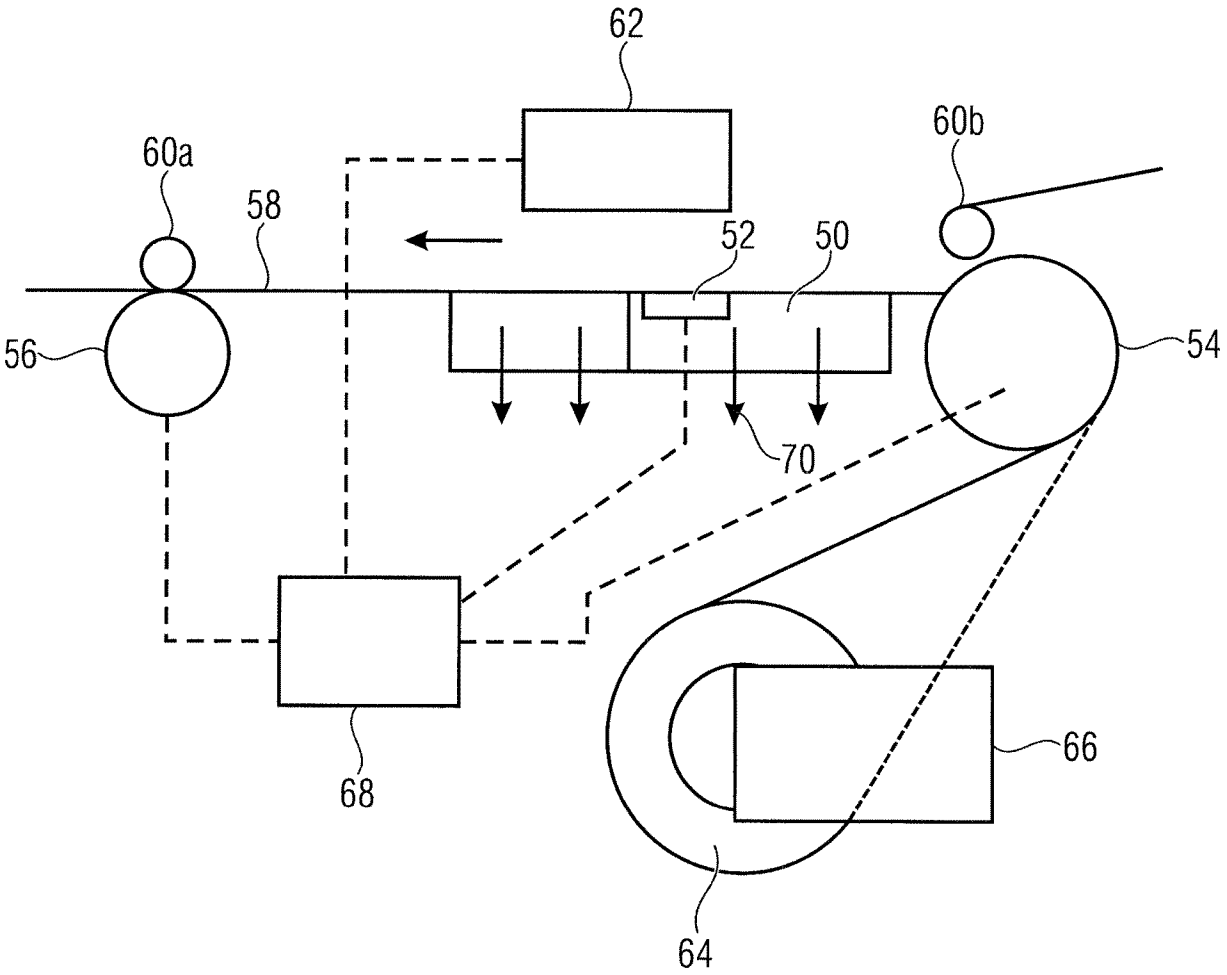
FIG. 2 is a schematic block diagram of a printing system according to another example.

Referring now to FIG. 2 there is shown a simplified illustration of a printing system according to another example, which is suited for printing on roll media, such as paper rolls.

The printing system comprises a platen 50, a sensor 52, drive rollers 54 and 56 to move medium 58 through a printing zone comprising platen 50, pinch rollers 60*a* and 60*b*, a print unit 62, an input spindle 64, a rewinder mechanism 66 and a controller 68. The medium is loaded onto the input spindle 64. The input spindle 64 may be driven by rewinder mechanism 66 to provide back tension to the medium 58. The medium 58 is fed around drive roller 54 under the pinch wheel 60*a*, over platen 50 in the printing zone and finally the medium 58 is driven out by means of drive roller 56 and pinch roller 60*b*, wherein the direction of movement is shown by an arrow in FIG. 2. Thereafter, medium 58 may be cut or may be collected in a take-up reel (not shown). Platen 50 includes suction holes (not shown) to apply a vacuum (suction force) to medium 58 as indicated by arrows 70 in FIG. 2. Sensor 52 is provided to detect and control advancement of medium 58. Sensor 52 may be an optical media advance sensor and may be located on a cutout section of platen 50. Sensor 52 may be able to detect very small errors in the advancement of medium 58 and these advancement errors may be communicated to the servo motors of the drive rollers 54, 56 and small correction adjustments may be applied to the movement of the medium.

Controller 68 may be in communication with drive rollers 54, 56, sensor 52 and print unit 62 as shown by broken lines in FIG. 2. Controller 68 is an example for a controller which may be for determining degradation of suction power and for taking corrective measures as described herein. Print unit may be any print unit such as an inkjet print unit having a number of printheads for applying ink of at least one color to medium 58 while medium 58 is moved through the printing zone.

Figure 3:
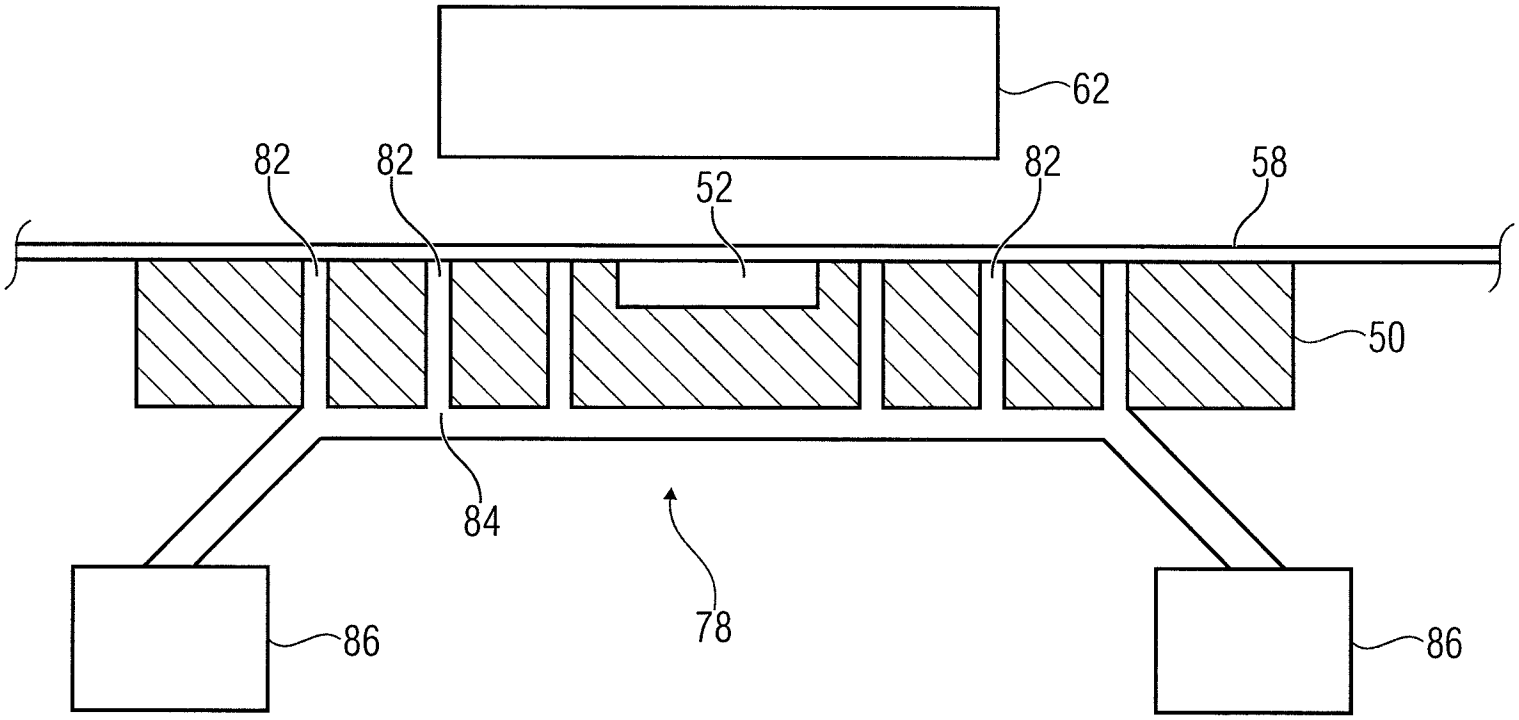
FIG. 3 is a schematic view of a printing zone area according to one example.

An enlarged view of the printing zone area is shown in FIG. 3. As shown in FIG. 3, a suction force generator 78 comprises suction holes 82, suction channels 84 and two suction sources 86, such as fans. The fans may work at a certain adjustable rotation speed (duty) and may provide vacuum suction forces in two separated printing zone areas on both sides of sensor 52. By the vacuum suction forces, media 58 are hold down on platen 50.

Figure 4:
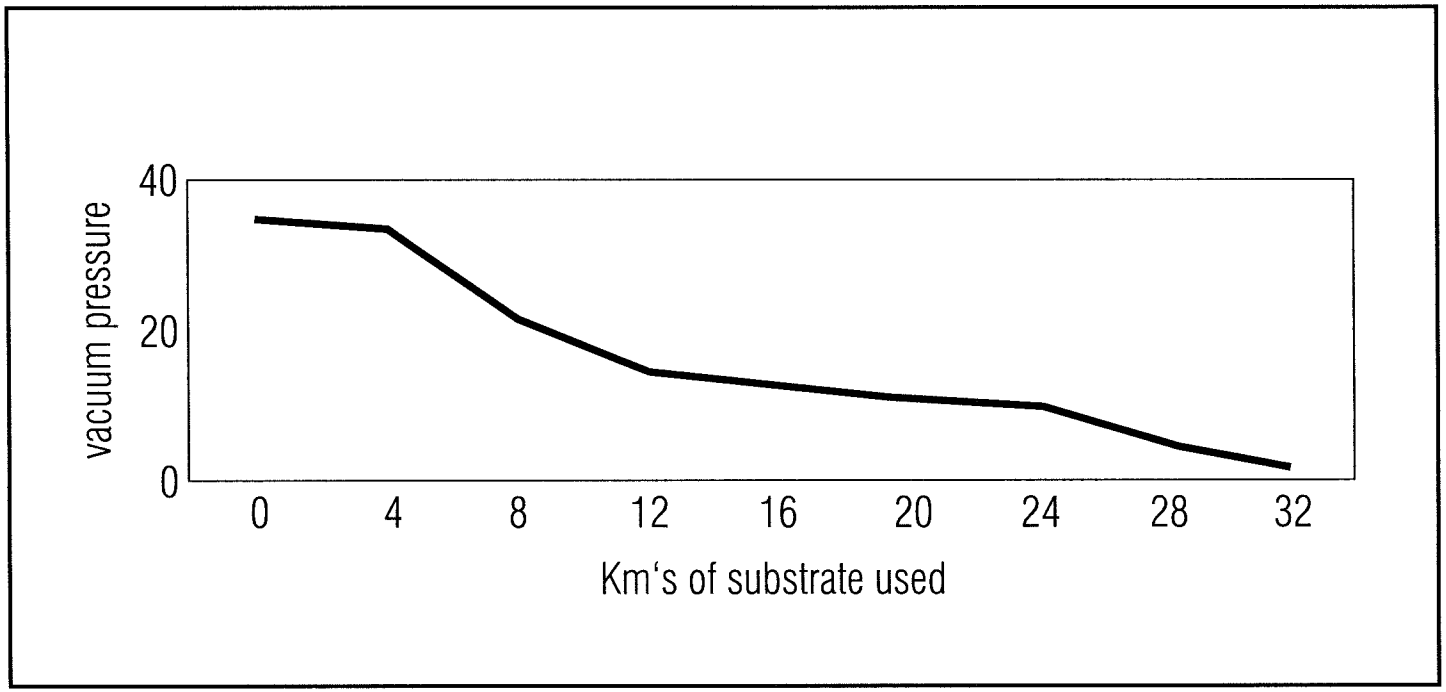
FIG. 4 is a diagram showing vacuum degradation over usage.

As set forth above, during printing, aerosol deposits may accumulate in the suction force channels 84 and may impair the vacuum suction capability of the vacuum suction generator. FIG. 4 is a diaphragm showing the suction pressure provided by the vacuum suction generator when operated at the same rotation speed over usage of a printing system. It can be seen that the suction force is substantially degraded with time upon printing. In FIG. 4, the abscissa shows the length of the medium which was printed on.

Figure 5:
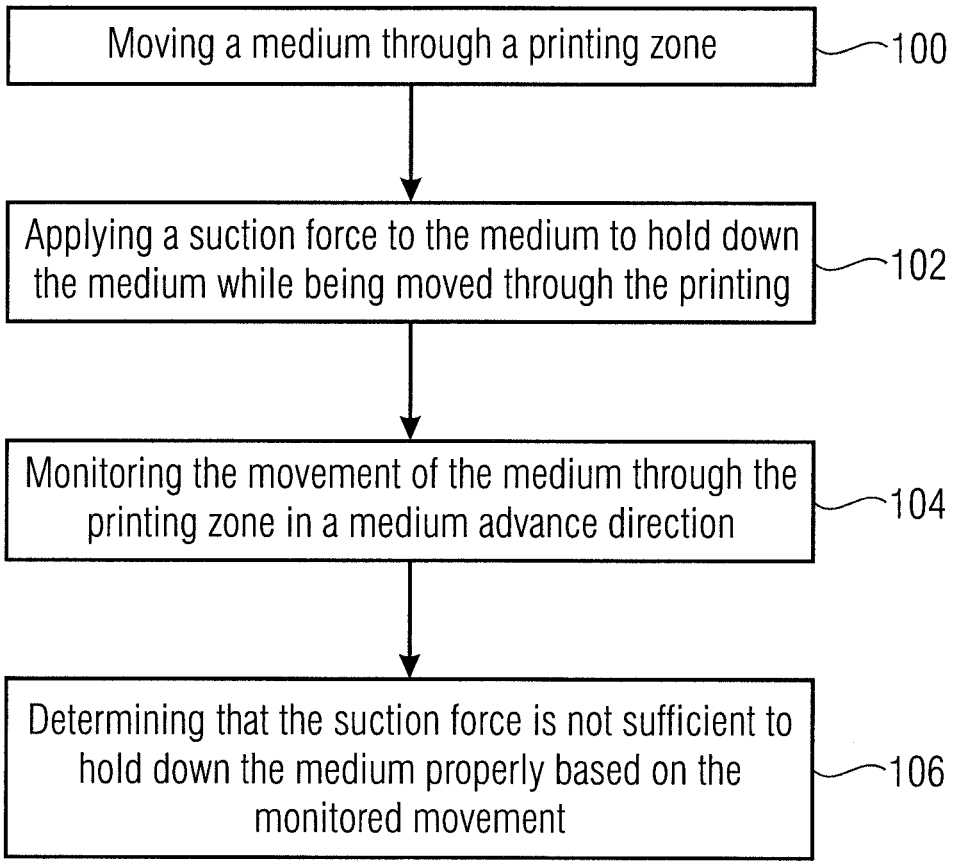
FIG. 5 is a flow diagram outlining a method of operating a printing system according to one example.

FIG. 5 shows a method as described herein. At 100, a medium is moved through a printing zone of a printing system. At 102, a suction force is applied to a medium to hold down the medium while the drive moves the medium through the printing zone. At 104, the movement of the medium through the printing zone in a medium advance direction is monitored. At 106, it is determined that the suction force is insufficient to hold down the medium properly based on the monitored movement.

Figure 6:
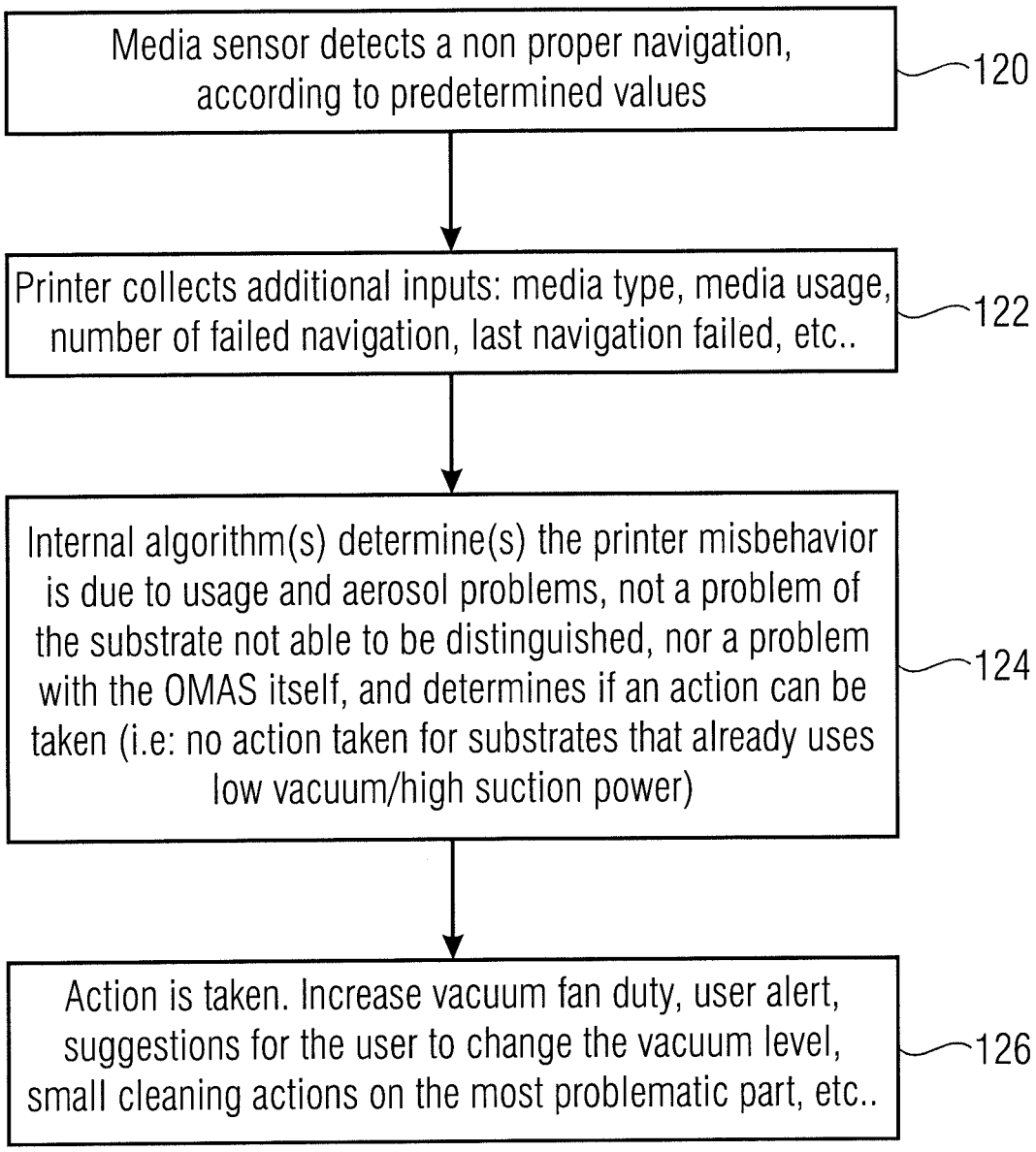
FIG. 6 is a flow diagram outlining a method of operating a printing system according to another example.

FIG. 6 shows a flow diagram of a method according to another example. At 120, a media sensor detects that navigation is non-proper. Detection that navigation is non-proper may be according to predetermined values. To be more specific, an output of the media sensor may be compared to intended predetermined values and if the output deviates from the intended predetermined values by more than a threshold it is detected that the navigation is non proper. Alternatively, at 120 one of the specific conditions of the media advance factor explained above may be detected as an indication that the navigation is non-proper. At 122, the printing system may collect additional inputs, such as media type, media usage, number of failed navigation, last navigation failed, etc.

This additional inputs may be used at 124 by an internal algorithm in determining whether the printer misbehavior is due to usage and aerosol problems and not another problem, such as a problem that the substrate cannot be distinguished or such as a problem of the sensor itself. Any algorithm described herein may be performed by controller 68 or another computing device of the printing system. For example, if the media type indicates that the medium is transparent or textile with open mesh, this may be interpreted by the algorithm as an indication that the navigation failure is not due to insufficient suction power. For example, if a number of failed navigations exceeds a threshold or if the time period since the last failed navigation is below a time threshold, this may be interpreted by the algorithm as an indication that the navigation failure is due to problems with the suction power.

Generally, the first signal of vacuum loss may be the inconsistency of the media factors calculated for a given substrate. It may not be big enough as to give early signals, but monitoring the tendencies of the media factor for a given loaded roll (taking also into account maybe other values like media roll left) may be the first to do. Defocused photos may occur in more extreme cases, but the level of focus may also be monitored and may act as another indicator that can be used in connection with other factors.

In addition, the internal algorithm may determine if an action can be taken, such as increasing the vacuum power or alerting a user. In examples, the controller will in either case output an alert to a user in addition to increasing the suction power. For example, for substrates using a high suction power it may be determined that the suction power cannot be further increased. In such cases no action concerning the suction power will be taken, but a user alert will be output. At 126, the determined action is taken. For example, the vacuum fan duty may be increased, a user alert may take place, the user may be informed that maintenance is needed, the user may be suggested to increase the vacuum level manually, the user may be suggested to perform small cleaning actions on the most problematic part of the suction force generator, etc.

FIG. 7 shows a table including the outputs of a specific sensor, i.e. the OMAS sensor by Hewlett-Packard Company. Column "getCurrentOLF" shows the determined media factor value. A value of 1000000 means that no media factor could be calculated. The term round in FIG. 7 refers to respective advances between print swaths.

Column A shows that a non proper navigation of the medium yields frequent errors in the media factor. This is shown by the values 1000000 in column "getCurrentOLF". Column B shows a case in which the medium is out of focus because of poor vacuum applied, i.e. because the suction force is too low. This results in a consistent error in the media factor calculations. Column C shows a case in which the substrate is navigating normally so that a proper media advance factor can be calculated. Slightly different values are shown in column C according to fine advance adjustments.

Figure 8:
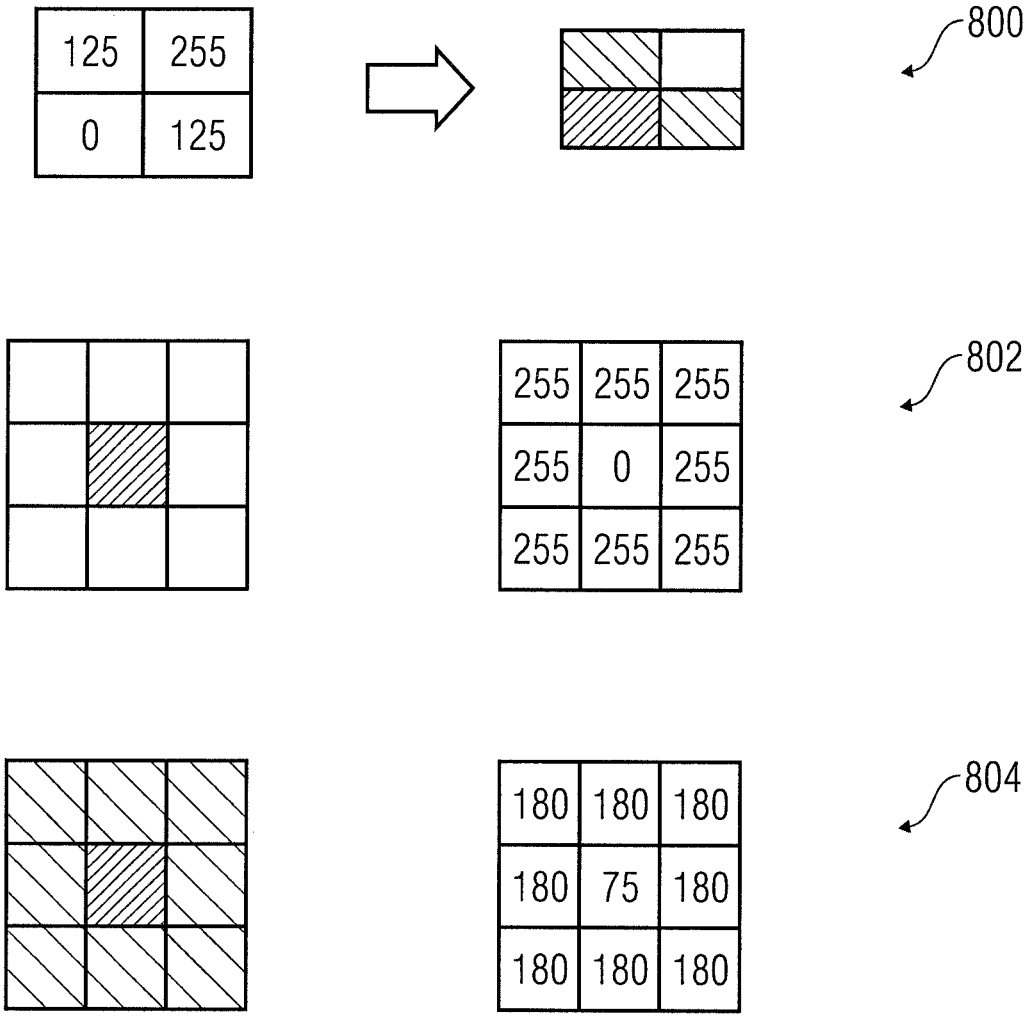
FIG. 8 shows schematic views of pixels and associated values.

Determination of whether pictures are out of focus may be made in any conceivable manner. For example, the output of the sensor may be a grayscale image. Every pixel has a grayscale value from absolutely black (0) to pure white (255). The more contrast a pixel has with respect to its neighbours the more focused the image is. The differences between neighbours can be determined as shown in FIG. 8. For example, an image sensor may be composed of an array of cells, one for every pixel (for example (96×512 cells). Each cell reveals a gray value from 0 to 255, where 0 is absolutely black and 255 is pure white. Four pixel and the associated values are shown at 800 in FIG. 8. In a sharp, well focused image, the difference between one pixel and its neighbours will be higher than in a blurry, defocused image where there will be smoother gray transitions. At 802 in FIG. 8, an array of nine pixel is shown representing a well-focused black dot in the center of a white image. The focus calculation for this pixel would be (255−0)*8=2040. At 804 in FIG. 8, an array of nine more de-focused pixel is represented. A gray level is distributed to the surrounding white pixel and, therefore, the focus count for this array would be (180−75)×8=840. Such a calculation may be performed on all pixels and the resulting average is a measure for how defocused the picture is. The more defocused the image is, the lower the resulting measure is. If the sensor is navigating over a transparent medium or with no medium travelling over the sensor, the resulting picture will have a mid-level of gray everywhere without substantial contrast between a pixel and it neighbours. In examples, determination whether an image is out of focus may be performed based on the technique of how the autofocus works on digital cameras, wherein the camera of the sensor remains focused on the fixed region of the printing zone.

In examples, iterative methods can be used. After a certain condition is fulfilled, a proactive compensation can be performed around a nominal value, the result may be monitored and it may be decided if the nominal value needs to be adjusted or may be maintained. In examples, if a possible problem is detected based on the output of the sensor, the suction force may be increased by a first amount and the effect can be monitored. If there is no change this may be an indication that the change is not sufficient to compensate. Thus, the suction force may be further increased by a second amount larger than the first amount, the process may be repeated, and so on. Upon increasing the suction force and upon determining that the problem has been solved (i.e. proper navigation is obtained), the suction force may be decreased again to the nominal level to see if, back to the nominal level, proper navigation is still obtained. If so, this situation may be considered as representing a transitory status solved by temporarily increasing the suction power.

Examples herein permit determining that suction force is insufficient due to aerosol particles deposited in suction force channels and/or suction force openings of a suction force generator. In examples, vacuum effectiveness can be improved on printing systems where vacuum applied pressure is diminished because of aerosol deposits. In examples, vacuum losses may be detected early. In examples, printer vacuum conditions can be ensured due to timely service maintenance actions. In examples, misbehavior of the printer due to crashes or smears (if the medium comes into contact with a printhead) can be avoided. In examples, additional costs due to early user complaints can be avoided. In examples, waste of ink and/or media due to ruined jobs can be avoided.

Examples relate to a non-transitory machine-readable storage medium encoded with instructions executable by a processing resource of a computing device to perform methods described herein.

Examples relate to a non-transitory machine-readable storage medium encoded with instructions executable by a processing resource of a computing device to operate an electrostatic printing system. The electrostatic printing system comprises a charging unit to charge the photoconductor member to a charged voltage, an imaging unit to generate a latent electrostatic image on the photoconductor member by discharging areas of the charged photoconductor member and a developer unit to develop a toner image on the photoconductor member using a developer voltage. The electrostatic printing system may be operated to perform a method, the method comprising: changing the developer voltage, and changing the charged voltage dependent on the change of the developer voltage.

It will be appreciated that examples described herein can be realized in the form of hardware, machine readable instructions or a combination of hardware and machine readable instructions. Any such machine readable instructions may be stored in the form of volatile or non-volatile storage such as, for example, a storage device like a ROM, whether erasable or rewriteable or not, or in the form of memory such as, for example, RAM, memory chips, device or integrated circuits or an optically or magnetically readable medium such as, for example, a CD, DVD, magnetic disk or magnetic tape. It will be appreciated that the storage devices and storage media are examples of machine-readable storage that are suitable for storing a program or programs that, when executed, implement examples described herein.

All of the features disclosed in the specification (including any accompanying claims, abstract and drawings), and/or all the features of any method or progress disclosed may be combined in any combination, except combinations where at least some of such features are mutually exclusive. In addition, features disclosed in connection with a system may, at the same time, present features of a corresponding method, and vice versa.

Each feature disclosed in the specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

What is claimed is:

1. A printing system comprising:

a printing zone comprising a platen;

a drive to move a medium through the printing zone;

a suction force generator to generate a suction force to hold down the medium onto the platen while the drive moves the medium through the printing zone;

a sensor to monitor the movement of the medium through the printing zone in a medium advance direction; and a controller to determine that the suction force generated by the suction source generator is insufficient based on an output of the sensor and at least one of:

an amount of ink or toner consumed by the printing system;

distance by which the medium has been moved through the printing zone by the drive upon loading the medium into the printing system; and a type of the medium.

2. The printing system of claim 1, wherein the suction force generator comprises a suction force source, at least one suction force channel and at least one suction force opening in the platen.

3. The printing system of claim 1, wherein the sensor comprise a camera to capture pictures of the medium successively while the medium is moved through the printing zone and to determine movement of the medium by correlating successive ones of the pictures with each other.

4. The printing system of claim 1, wherein the controller is to determine that the suction force is insufficient if the output of the sensor indicates at least one of the following conditions:

a distance by which the medium is moved is not determined or a distance by which the medium is moved deviates from a nominal distance by more than a distance deviation threshold;

the sensor does not determine a media advance factor;

a change of the media advance factor exceeds a media advance factor change threshold;

a rate of change of the media advance factor exceeds a media advance factor change threshold;

a difference of the media advance factor from a nominal media advance factor exceeds a media advance factor difference threshold; and pictures captured by a camera are out of focus.

5. The printing system of claim 1, wherein the controller is to determine that the suction force is insufficient based on the output of the sensor and if the amount of ink or toner consumed is above a specific threshold.

6. The printing system of claim 1, wherein the controller is to determine that the suction force is insufficient based on the output of the sensor and if the medium has been moved through the printing zone by not more than a specific distance upon detection that the medium was loaded into the printing system.

7. The printing system of claim 1, wherein the controller is to control the suction force generator upon determining that the suction force generated by the suction source generator is insufficient to increase the suction force and/or to inform a user that the suction force is insufficient via a user interface.

8. A method comprising:

moving a medium through a printing zone of a printing system;

applying a suction force to a medium to hold down the medium while a drive moves the medium through the printing zone;

monitoring the movement of the medium through the printing zone in a medium advance direction; and determining that the suction force is insufficient to hold down the medium based on the monitored movement and at least one print parameter from a group of printer parameters comprising:

an amount of ink or toner consumed by the printing system, a distance by which the medium has been moved through the printing zone by the drive upon loading the medium into the printing system, and a type of the medium.

9. The method of claim 8, wherein monitoring the movement of the medium comprises capturing pictures of the medium successively while the drive moves the medium through the printing zone and correlating successive ones of the pictures with each other.

10. The method of claim 8, wherein it is determined that the suction force is insufficient if monitoring the movement of the medium reveals at least one of the following conditions:

a distance by which the medium is moved is not determined or a distance by which the medium is moved deviates from a nominal distance by more than a distance deviation threshold;

a media advance factor is not determined;

a change of the media advance factor exceeds a media advance factor change threshold;

a rate of change of the media advance factor exceeds a media advance factor change threshold;

a difference of the media advance factor from a nominal media advance factor exceeds a media advance factor difference threshold; and pictures captured by a camera are out of focus.

11. The method of claim 8, comprising taking an action upon determining that the suction force is insufficient to hold down the medium, wherein the action comprises at least one of increasing the suction force and informing a user that the suction force is insufficient via a user interface.

12. A non-transitory machine-readable storage medium encoded with instructions executable by a processing resource of a computing device to operate a printing system to:

move a medium through a printing zone of a printing system;

apply a suction force to a medium to hold down the medium while a drive moves the medium through the printing zone;

monitor the movement of the medium through the printing zone in a medium advance direction; and determine that the suction force is insufficient to hold down the medium based on output of a sensor that indicates at least one of:

a distance by which the medium is moved is not determined; and a picture captured by a camera is out of focus.

13. The non-transitory machine-readable storage medium of claim 12, wherein at least one of additional printer parameters is considered in determining that the suction force is insufficient, wherein the additional printer parameters comprise an amount of ink or toner consumed by the printing system, a distance by which the medium has been moved through the printing zone by the drive upon loading the medium into the printing system, and a type of the medium.

14. The non-transitory machine-readable storage medium of claim 12, wherein determining the suction force is insufficient when monitoring the movement of the medium reveals a distance by which the medium is moved deviates from a nominal distance by more than a distance deviation threshold.

15. The non-transitory machine-readable storage medium of claim 12, wherein determining the suction force is insufficient when monitoring the movement of the medium reveals a media advance factor is not determined.

16. The nom-transitory machine-readable storage medium of claim 12, wherein determining the suction force is insufficient when monitoring the movement of the medium reveals a change of the media advance factor exceeds a media advance factor change threshold.

17. The non-transitory machine-readable storage medium of claim 12, wherein determining the suction force is insufficient when monitoring the movement of the medium reveals a rate of change of the media advance factor exceeds a media advance factor change threshold.

18. The non-transitory machine-readable storage medium of claim 12, wherein determining the suction force is insufficient when monitoring the movement of the medium reveals a difference of the media advance factor from a nominal media advance factor exceeds a media advance factor difference threshold.

* * * * *